United States Patent [19]

Lomberg

[11] Patent Number: 4,909,720

[45] Date of Patent: Mar. 20, 1990

[54] EXTRUSION MOLDING TOOL

[75] Inventor: Alfons Lomberg, Bottrop, Fed. Rep. of Germany

[73] Assignee: Krupp Widia GmbH, Essen, Fed. Rep. of Germany

[21] Appl. No.: 344,976

[22] Filed: Apr. 28, 1989

[30] Foreign Application Priority Data

Apr. 30, 1988 [DE] Fed. Rep. of Germany ..... 3814687

[51] Int. Cl.[4] ..... B29C 47/12; B29C 47/16

[52] U.S. Cl. ..... 425/190; 425/465; 425/466; 425/467

[58] Field of Search ..... 425/461, 465, 467, 190, 425/466

[56] References Cited

U.S. PATENT DOCUMENTS 3,496,605 2/1970 Onaka ..... 425/467

3,608,138 9/1971 Marcovitch ..... 425/467

FOREIGN PATENT DOCUMENTS 8536805 2/1986 Fed. Rep. of Germany .

*Primary Examiner*—Willard Hoag

*Attorney, Agent, or Firm*—Spencer & Frank

[57] ABSTRACT

An extrusion molding tool for the production of a drill blank made of a plastic raw material by extruding the material in a longitudinal extrusion direction across a production mandrel and through a bore in a die, the bore having a longtiudinal axis, the mandrel having at least one elastically deformable wire radially spaced from the longitudinal axis projecting into an intake end of the bore for forming at least one internal helical rinsing bore in the drill blank, wherein the die includes a plurality of annular discs disposed one behind the next in the longitudinal direction. The discs have respective interior surfaces surrounding the longitudinal axis and together define the bore. The interior surfaces have ribs which when properly aligned together form a helical radially inwardly projecting ridge extending at a helix angle with respect to the longitudinal direction to define a means for twisting the raw material passing through the bore. The discs are rotatable relative to one another about the longitudinal axis to adjust the helix angle. Means are provided to adjustably fix the discs against rotation to set the helix angle.

33 Claims, 5 Drawing Sheets

EXTRUSION MOLDING TOOL

REFERENCE TO RELATED APPLICATIONS

This application claims the priority of Federal Republic of Germany application Ser. No. P 38 14 687.8 filed Apr. 30th, 1988, which is incorporated herein by reference.

BACKGROUND OF THE INVENTION

The present invention relates to an extrusion molding tool for the production of a hard metal or ceramic drill blank (green blank) made from a plastic raw material and including at least one interior helical rinsing bore, the tool including a shaping die and a mandrel disposed in the intake region of the die. Outside of the longitudinal axis of the die, the mandrel is provided with at least one elastically deformable wire which projects into the die. The shaping cross section of the die includes an inwardly oriented structure which extends helically around the longitudinal axis of the die so as to twist the passing raw material to form one or more helical grooves therein.

Such an extrusion molding tool is disclosed in German Utility Model Patent No. 85/36,805. It is based on the idea that the twisting and the production of the rinsing bore can be performed during formation of the drill blank in one process step together with the extrusion molding. In the known twisting process, the elastic wires provided at the mandrel of the extrusion molding tool produce rinsing bores corresponding to the wire diameters and the uniform geometry of these bores is not destroyed by later process steps. Because of the fact that the blank is twisted by means of helically extending guide projections simultaneously with the extrusion molding process, the twisting no longer depends on external parameters such as the material flow rate in the extrusion press. Independently of the speed with which the punch presses the material into and through the die, the pitch in the hard metal or ceramic drill blank will always be uniform. The twisted drill blank can then be brought to the desired length by a severing process.

Corresponding to the number of desired rising bores, the mandrel of the extrusion molding tool is equipped with one or several wires made of an elastically deformable material. This material should be such that each wire is able to adapt itself to the screwing movement of the raw material in the region of the die with the least possible resistance to deformation and thus to cause the helical rinsing bore to be produced in the plastic raw material. Copper alloys or nonferrous metal alloys, iron, iron alloys, light metals and light metal alloys, particularly those including aluminum, are suitable as the elastic wire material. The use of plastics, such as polyamide, has also been found to be particularly advantageous, also as a coating for otherwise metal wires. With the mutual association of wire and projection in the region of the die, the position of the resulting rinsing bore relative to the helical groove or grooves formed in the drill can be determined. For example, in an embodiment having two grooves and two interior rinsing bores, the angle between the respective connecting lines may be 0° or 90° or take on any desired intermediate values. According to previous experiences, the helix angle of the helical projection in the die should be selected somewhat larger than the helix angle desired for the drill blank grooves; generally the overdimension lies at about 3° to 7°.

It has also been found to be advisable to select the length of the die and of the wires to be at least long enough that the helical projection in the die describes a helix of more than 90°, preferably more than 180°.

German Patent Application Pat. No. 3,714,479.0 discloses arranging the die and the mandrel so as to be fixable in various positions relative to one another in order to be able to inexpensively vary the mutual association of the mentioned components, which influence the formation of the drill blank to be produced, if need be during the extrusion molding process. In such an extrusion molding tool it is possible, on the one hand, to rotate the die and the mandrel relative to one another if the helical rinsing bore is to take on a different angular position relative to the chip (shaving) space of the extruded drill blank. On the other hand, both components can also be longitudinally displaced relative to one another, thus imparting either a greater or lesser deformation to the wire in the direction toward the longitudinal axis of the die and thus making it possible to vary the distance between the rinsing bore and the longitudinal axis of the die.

However, prior art extrusion molding tools have the drawback that selection of the die determines the shape of the helix and the drill type. To be able to work with the same extrusion molding tool, it is necessary to change the die to produce blanks having a different groove pitch or a different diameter, thus requiring the extrusion molding tool to be disassembled from its associated holding structure. The work involved with this is complicated and time consuming.

Additionally, there is a desire to manufacture drills of different diameters, for example from 3 mm to 6 mm, with one and the same extrusion molding tool and the respective drill is to be produced from a blank having a diameter of 6 mm. In this case, all drills, although they have different diameters, should have the same pitch, for example a pitch of 30°. Since the length of the path over which a helix having a certain pitch, e.g. 30°, describes a full circle (360°) in a 6 mm drill differs from the corresponding path in a 3 mm drill likewise having a 30° helix, a 6 mm drill blank cannot be reduced in diameter to 3 mm simply by grinding material away since this would inevitably cut into the rinsing bore helixes. In other words, the rinsing bore would be exposed on the drill circumference. For this reason as well, it is necessary to install a different die in the extrusion molding tool for each drill diameter.

SUMMARY OF THE INVENTION

It is therefore an object of the present invention to further modify the above-described extrusion molding tool so that, for one and the same die, the geometry of the drill blank can be changed at the least possible expense.

This is accomplished b the extrusion molding tool for the production of a drill blank made of a plastic raw material by extruding the material in a longitudinal extrusion direction across a production mandrel and through a bore in a die, the bore having a longitudinal axis, the mandrel having at least one elastically deformable wire radially spaced from the longitudinal axis projecting into an intake end of the bore for forming at least one internal helical rinsing bore in the drill blank, wherein the die includes a plurality of annular discs disposed one behind the next in the longitudinal direction. The discs have respective interior surfaces surrounding the longitudinal axis and together define the bore. The interior surfaces have ribs which when properly aligned together form a helical radially inwardly projecting ridge extending at a helix angle with respect to the longitudinal direction to define a means for twisting the raw material passing through the bore. The discs are rotatable relative to one another about the longitudinal axis t adjust the helix angle. Means are provide to adjustably fix the discs against rotation to set the helix angle.

The particular advantage of the die composed of individual annular discs is that they can be exchanged as desired and also rotated relative to one another so that already a set including a small number of annular discs provides a plurality of possible combinations for configuring the die. By rotating the annular discs relative to one another in the appropriate manner, the ribs disposed on the interior wall of the die are displaced, thus changing the pitch of the helix.

Preferably, the die is held, on its discharge side facing away from the mandrel, by a tightening nut whose support face, which lies against the die and is movable in the longitudinal direction of the die holder, can be fixed in different positions relative to the die. Displacement of the tightening nut is therefore possible relative to the die holder which then requires additional clamping and tightening elements to fix it. It is, however, also possible for the tightening nut to form a screw connection with the die holder and to lie with its end face facing away from the die against the supporting face of a fixing ring. Preferably, the die holder itself is given a releasable protection against axial or rotational displacement.

Instead of the one-piece die which has a uniform helix in the form of a rib (ridge) or groove, each annular disc is now provided with one or a plurality of ribs or grooves to define a composite ridge. These parts are all configured in such a manner that easy displacement of their angular position, when seen in the direction of the extrusion process, produces a change in the helix and in the pitch of the helix, respectively. Although this brings about the unavoidable drawback that the edges change suddenly along the helix set by the annular discs, the shape f the ribs takes care that the sudden edge changes are as slight as possible and have no influence on the quality of the extrusion molded product.

It is particularly recommended to configure the ribs of each annular disc uniformly and to give each component a shape which s tapered in a direction opposite the extrusion molding (longitudinal) direction. In this way, the helix will have a structure which is comparable to a fir tree of the same diameter seen from the top. In this way, the material to be extrusion molded will find a relatively low resistance. The ribs may have a semicircular or rectangular cross section, the rectangular cross-sectional shape being preferred. When seen from the top (in a radially outward direction), the respective ribs have a trapezoidal shape with their broader base face lying on the exit or discharge side of the extruded material. Preferred is a base face which is 1.1 to three times as large as the opposite side or face. The side faces of each rib are inclined relative to the base (plane) which is perpendicular to the direction of extrusion molding, with one angle being acute, the other obtuse. The angles of inclination lie between 30° and 70°, prefeably between 35° and 50°, on the one hand, and between 100° and 140°, preferably between 110° and 125°, on the other hand. This means that with angles of, for example 120° and 40°, measured relative to the base, the ribs have two extreme positions at which one of the rib side faces of each rib is aligned with corresponding rib faces of a rib of each successive disc, only one of the rib side faces is steady and the individual components lie flush against one another. In the one case, the helix angle is 30°, in the other it is 50°.

In principle, the person skilled in the art is free to select the number of juxtaposed helix turns; for example, he may make do with two rib helixes. Preferably, however, 10 to 40 ribs should be disposed at equidistant spacings on the interior of the die disc. The more ribs that are employed, the smaller is their selected cross section.

According to a further feature of the invention, the annular discs are given a chamfer on both sides of their outer edge faces.

In order to be able to influence the spacing of the rinsing bore helix from the longitudinal axis of the drill blank, die and mandrel are arranged, according to a further feature of the invention, to be fixable in mutually different positions. Preferably, die and mandrel should be rotatable relative to one another about the longitudinal axis of the die and/or should be held so as to be displaceable relative to one another in the longitudinal direction. The rotational adjustability permits the assumption of an angular position between the rinsing bore and the helical groove of the produced drill blank, which is different compared to the previous starting position. By displacing the die longitudinally relative to the mandrel, the distance of the rinsing bore from the longitudinal axis of the blank can be set. A greater distance between die and mandrel results in greater bending deformation of the wire by the plastic raw material and thus in a smaller distance between the rinsing bore and the mentioned longitudinal axis. A displacement of the mandrel in the opposite direction permits this distance to be increased.

In an advantageous embodiment of the invention, a basic holder or holding ring, supporting the mandrel, is connected with the die holder by way of a clamping ring, with the clamping ring being rotatably supported n a flange of a receptacle of the die holder. By rotating the clamping ring, the lock between the holding ring and the die holder can be released so that the mandrel and the die can be rotate relative to one another. The connection between the holding structure of the extrusion molding tool and the holding ring can remain in effect.

According to a further feature of the invention, the die holder is movably supported by way of a straight-line guide at the receptacle. The straight-line guide may here be realized in a simple manner in that the exterior face of the die holder is provided with a longitudinal groove into which engages the receptacle by way of a projection for example in the form of a cylindrical pin.

To ensure that the plastic raw material fills the mold chamber immediately following the mandrel outside the region of the elastic wire or wires, the mandrel is given a conical shape in the region of its frontal section, with the cone angle being at least 90°, preferably about 120°.

To facilitate the rotary displacement of the abutting annular discs, the extrusion molding tool is provided with a adjustment mandrel which can be introduced into the die from the outside and which is composed of an essentially cylindrical body provided with one or a plurality of helical ribs on its outer circumference. The width of the ribs is less than the spacing of the ribs in the annular discs. Aside from the rib-like projections, the adjustment mandrel has a diameter which is adapted to the interior of the die. Therefore, a special mandrel exists for each helix pitch, unless the adjustment mandrel cylinder is constructed of individual annular discs which are rotatable and fixable relative to one another similarly to the die. If it is desired to change the helix angle of the die, for example from 35° to 40°, the clamping devices (clamping nuts) acting on the annular discs are released and the adjustment mandrel is pushed gradually from the die discharge end into the die. The rib-shaped helixes of the adjustment mandrel then cause the die discs to be rotated relative to one another so that finally the helix angle formed by the ribs of the die coincides with that of the adjustment mandrel (when inserted). The annular discs are now clamped tight relative to one another before the adjustment mandrel is removed again. Advantageously, it is thus possible to change the helixes of the di without having to disassemble the extrusion molding tool in question. The number of parallel helixes of an adjustment mandrel depends of course on the number of helixes in the dies. If one operates with a die which has 10 to 40 helixes, it has been found to be of advantage for the adjustment mandrel to have more than three, preferably five helical ribs.

To facilitate introduction of the adjustment mandrel into the die, the former is provided with a manual guide member which is fastened to its rear face and which is preferably provided with a knurled gripping surface.

To prevent inadvertent displacement of already aligned annular discs when adjusting the next following annular discs, the cylindrical body of the adjustment mandrel is at least as long as the die is deep.

BRIEF DESCRIPTION OF THE DRAWINGS

These and other features and advantages of the invention can be better understood from the following detiled description of the preferred embodiments of the invention with references to the accompanying drawing figures in which.

DESCRIPTION OF THE PREFERRED EMBODIMENTS

Figure 1:
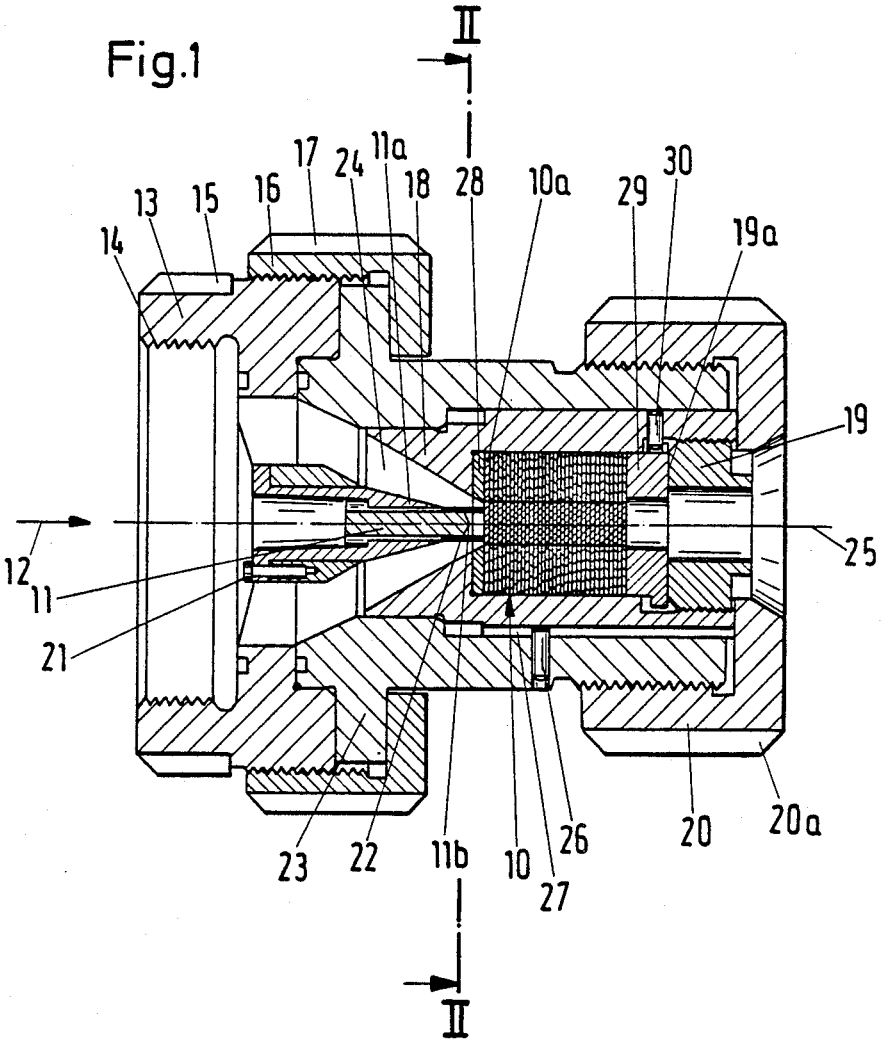
FIG. 1 is a vertical sectional view of an extrusion molding tool.
Figure 3:
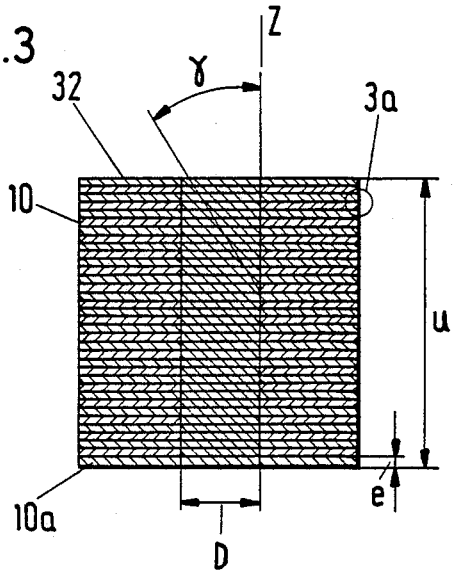
FIG. 3 is a vertical sectional view, to an enlarged scale, of a die.

The extrusion molding tool shown in FIG. 1, when seen in the extrusion direction indicated by arrow 12, includes as its essential components a die 10 composed of individual annular discs 10*a* (FIG. 3) and a mandrel 11 having a rearward section 11*a* and a conical front section 11*b*. *Mandrel 11 and die 10 are arranged one behind the other when seen in the extrusion direction represented by arrow 12.*

Figure 2:
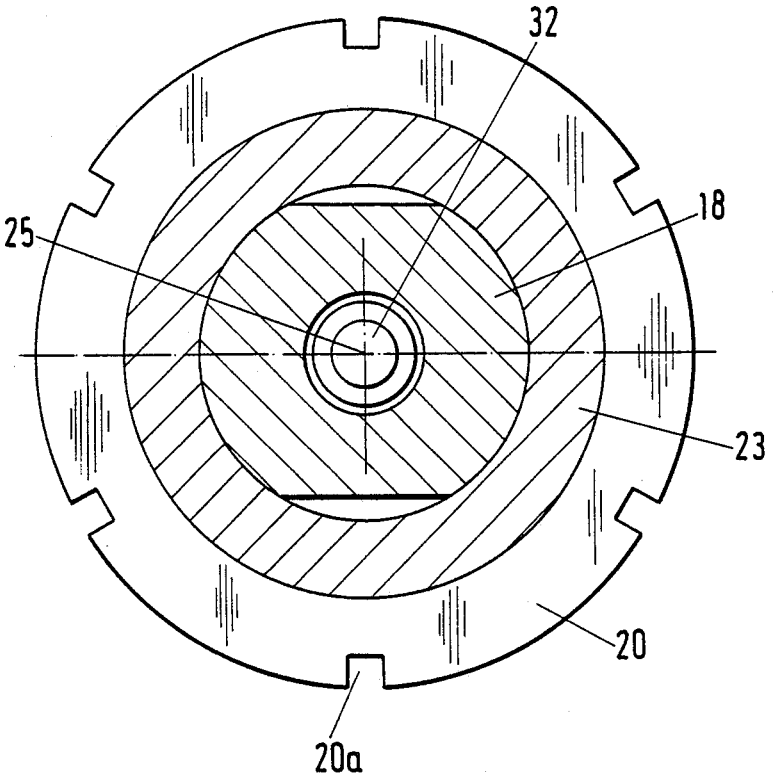
FIG. 2 is a sectional view along line II—II of FIG. 1.

Mandrel 11 is held by a basic holder (mandrel holder) 13 configured as a holding ring and provided with a threaded connecting bore 14 by way of which the extrusion molding tool can be fastened, for example, to a supporting structure (not shown) through which the plastic raw material t be processed is also supplied. Additionally, basic holder 13 is provided with exterior adjustment grooves 15. Basic holder 13 is surrounded by a clamping ring 16 having externally disposed adjustment grooves 17, with clamping ring 16 in turn surrounding rounding a receptacle 23 which itself surrounds die holder 18. A clamping nut 19 having a frontal supporting face 19*a* is disposed at the discharge end of the die and serves to clamp annular discs 10*a* in die holder 18. A fixing ring 20 is movable by way of external adjustment grooves 20*a*(see FIG. 2). For example, at three radially oriented webs (not shown) basic holder 13 is provided with a hub in which mandrel 11 is releasably held by way of a pan head screw 21. The position of mandrel 11 is secured in the longitudinal direction (extrusion direction 12) by way of the already mentioned rear section 11*a*.

Two wires 22 of an elastic plastic material exit from the conical front section 11*b* of mandrel 11. The plastic material should be of such consistency that it puts up the least possible bending deformation resistance to the deformation occurring during the extrusion molding process and has the least possible frictional resistance relative to the plastic raw material. The conical front section 11*b* has a cone angle of 120°.

The releasable connection between basic holder 13 an receptacle 23 is constituted by the described clamping ring 16 which is supported on a flange of receptacle 23 and, on the other hand, forms screw connection by way of a threaded bore with a corresponding threaded section of basic holder 13. By rotating clamping ring 16, the frontal face of receptacle 23 can be pressed against basic holder 13 while forming a rigid connection. Receptacle 23 and die holder 18 form a conical chamber which tapers in the longitudinal (extrusion) direction and opens into the interior of the die with a diameter which does not change over the length of the die. The tapering conical chamber is marked 24 and, as the die, is coaxial with the longitudinal die axis marked 25.

A straight-line guide of die holder 18, together with the die 10 inserted there, is composed of a guide pin 26 which simultaneously serves as a security against rotation and engage in a longitudinal groove 27 of die holder 18.

The position of die 10 with respect to die holder 18 and mandrel 11 can be fixed and changed, respectively, by selection of the thickness of contact disc 88, with this contact disc having an intake region corresponding to the above-mentioned conical chamber 24. It is of course also possible to set the respective die position by means of the fixing ring 20 and by way of die holder 18. At its end facing the extrusion side, contact disc 29 lies against the die with the clamping nut 19 lying against the opposite face of contact disc 29.

Cylindrical pin 30 in a hole in die holder 18 engages in slot or groove in contact disc 29 and thereby serve as security against rotation and as a connecting means for the die holder 18 and contact disc 29 with die 10 .

Figure 3A:
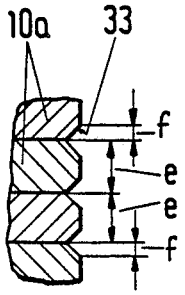
FIG. 3*a* is a detail view of a portion of the die shown in FIG. 3 to an enlarged scale.
Figure 4A:
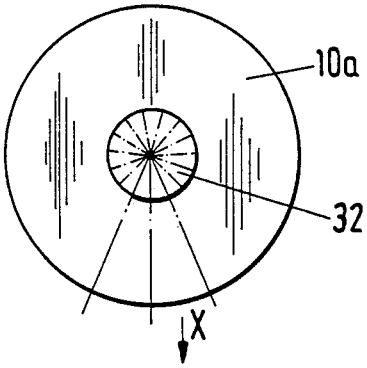
FIG. 4*a* is a rear view of the die of FIG. 3.
Figure 4B:
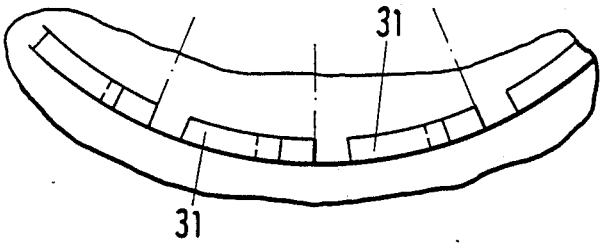
FIG. 4*b* is a vertical sectional view of a portion of the inner circumferential face of the die.
Figure 4C:
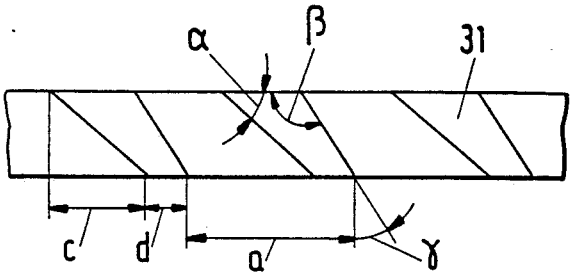
FIG. 4*c* is a top view of part of the circumferential face of the die.

Details of die 10 can be seen in FIGS. 3, 3*a*, 4*a*, 4*b* and 4*c*. According to these figures, die 10 is composed of a plurality of contacting annular discs 10*a*, with each annular disc being provided with internal ribs 31 which have a rectangular cross section. Seen from the top in the direction opposite to the extrusion direction, ribs 31 have a tapering trapezoidal configuration. The shape of the "oblique angle" trapezoids can be seen in FIG. 4*c*, with the respective angles $\alpha$ and $\beta$ of the trapezoid being about 35° and 115°, respectively. The rib spacing defined by the letter a is 4 mm, with the width c of the base of the trapezoid being 2.2 mm and that of the opposite face d being 1 mm. As a whole, 15 of these ribs 31 are disposed on each annular disc 10*a*. As can be seen in FIG. 3*a*, the outer edges of the outer circumferential surface of each disc 10*a* are each given a chamfer 33 of a width f. The thickness e of each annular disc 10*a* is 1 mm to 2 mm. In the present embodiment, a total of 35 annular discs are arranged one behind the other.

Figure 6:
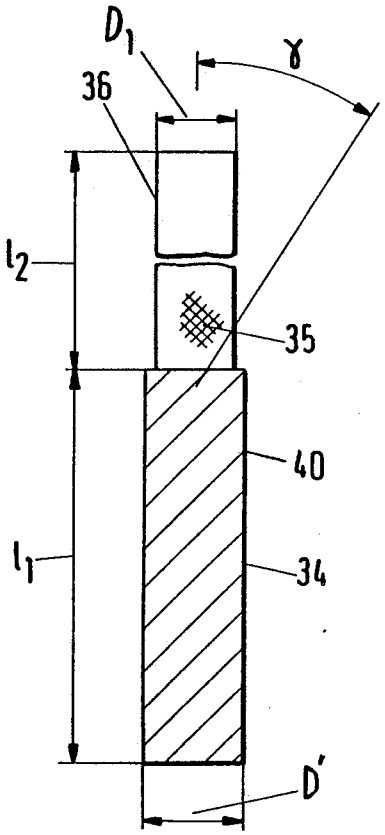
FIG. 6 is a side view of an adjustment mandrel.

The adjustment mandrel 40 of FIG. 6 employed to newly align the respective angle of rotation relative to the adjacent annular disc 10*a* has a diameter D' which is equal to or slightly less than the inner diameter D of the die. At its outer cylindrical face, the adjustment mandrel 40 of FIG. 6 is provided with a helical rib 37 which has a width 9 measured perpendicular to the mandrel axis 40', with the angle of the helix corresponding to the angle to which the die is to be set. Width b of the rib 37, measured perpendicularly in the direction of the helix, i selected in such a way that it is slightly less than the smallest distance between two ribs 31. For each helix pitch to be set there exists such an adjustment mandrel whose cylindrical body 34 has a length $l_1$ which is at least as long as the length of the die determined by the number of annular disc 10*a* behind one another. For better manipulation of the adjustment mandrel, the end face of the latter is provided with a handle 36 having knurls 35 and whose length $l_2$ corresponds approximately to the width of one hand. The diameter $D_1$ of handle 36 is slightly less than the diameter D' of the cylindrical body 34 of the adjustment mandrel 40.

Figure 5:
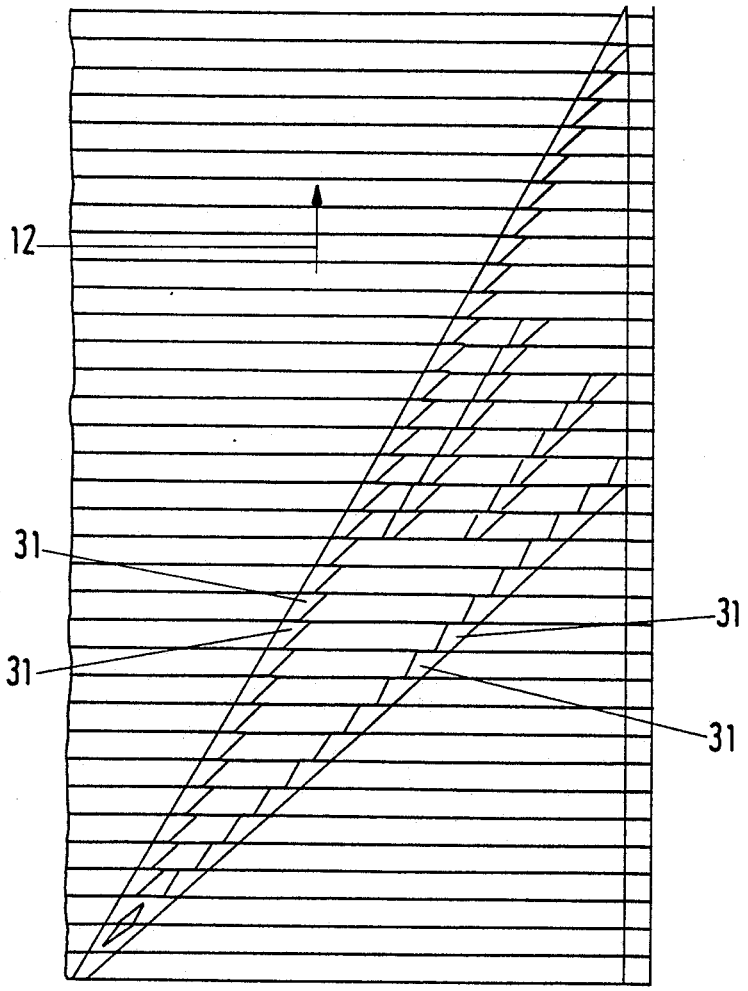
FIG. 5 is a view showing several developments of different die disc settings with different helix angles.
Figure 7A:
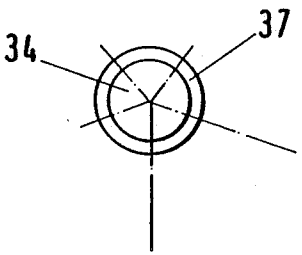
FIG. 7*a* is a rear view of the adjustment mandrel of FIG. 6.
Figure 7B:
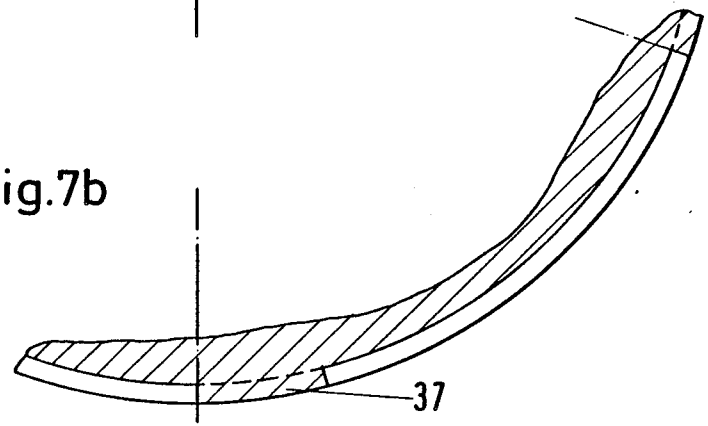
FIG. 7*b* is an enlarged sectional partial view of the circumferential face of the adjustment mandrel.
Figure 7C:
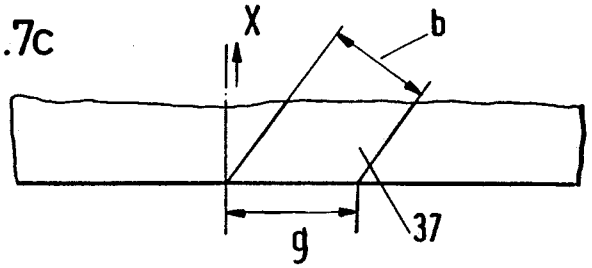
FIG. 7*c* is an enlarged top view of part of the rib-shaped helix on the circumferential face of the adjustment mandrel.

FIG. 5 shows a helix developed from the individual ribs 31 and its change by rotation of the respective annular discs 10*a*. Advisably, the trapezoidal shape of the individual ribs 31 should be selected in such a manner that the desired helix angles to be set lie between the two extreme states shown in solid lines in FIG. 5. In both extreme states, the trapezoidal side walls of ribs 31 are aligned with one another while a corresponding "fir-tree pattern" exists on the other side. If material is pressed through the die in the direction indicated by arrow 12, such material will relatively quickly fill the step-like projections of the tree pattern so that a continuous helix exists practically for any setting between the two illustrated extreme settings.

It will be understood that the above description of the present invention is susceptible to various modifications, changes and adaptations, and the same are intended to be comprehended within the meaning and range of equivalents of the appended claims.

What is claimed is:

1. In an extrusion molding tool for the production of a drill blank by extruding a plastic raw material in a longitudinal extrusion direction across a production mandrel and through a bore in a die, the bore having a longitudinal axis, the mandrel having at least one elastically deformable wire extending along said longitudinal axis and being spaced therefrom, said wire projection into an intake end of said bore for forming at least one internal helical rinsing bore in the drill blank, the improvement wherein the die comprises a plurality of annular discs disposed one behind the next in said longitudinal direction, said discs having respective interior surfaces surrounding said longitudinal axis and together defining said bore, said surfaces having a means for twisting the raw material passing through said bore, said means comprising a helical radially inwardly projection ridge extending at a helix angle with respect to said longitudinal direction and formed by aligned ribs formed on the respective interior surfaces, said discs being rotatable relative to one another about said longitudinal axis to adjust the helix angle, the tool further comprising means for adjustably fixing said discs against rotation to set said helix angle.

2. A tool as in claim 1, further comprising means, including a mandrel holder holding said mandrel and a die holder holding said die, for positioning said mandrel relative to said die, wherein said die holder has a releasable means for preventing axial and rotational displacement of said die holder relative to said mandrel and mandrel holder.

3. A tool as in claim 1, wherein each of said ribs has one of a semicircular and a rectangular cross section.

4. A tool as in claim 1, wherein each of said ribs is tapered in a direction opposite said longitudinal extrusion direction.

5. A tool as in claim 1, wherein each disc has between 10 and 40 of said ribs spaced equidistantly on said interior surface.

6. A tool as in claim 1, wherein each disc has an outer circmferential surface which is chamfered at axially opposite sides thereof.

7. A tool as in claim 1, wherein said ridge, when projected onto a plane perpendicular to said longitudinal axis, defines a circular arc of greater than 90 degrees.

8. A tool as in claim 7, wherein said arc is greater than 180 degrees.

9. A tool as in claim 1, wherein said mandrel has a front end beyond which said at least one wire projects in said longitudinal direction, said front end being conically shaped and having a cone angle of greater than 90 degrees.

10. A tool as in claim 9, wherein said cone angle is about 120 degrees.

11. A tool as in claim 18, wherein said adjustment mandrel has a manual guide member forward of said cylindrical body, for holding said adjustment mandrel while inserted said cylindrical body into said bore.

12. A tool as in claim 11, wherein said manual guide member has a knurled gripping surface.

13. A tool as in claim 11, wherein said cylindrical body and said ridge least as long as said die measured in said longitudinal direction.

14. A tool as in claim 1, further comprising a die holder holding said die, and means, including a clamping nut having a supporting face facing said die at a discharge end.

15. A tool as in claim 14, wherein said clamping nut is mounted in said die holder.

16. A tool as in claim 14, further comprising a fixing ring mounted on said die holder, wherein said clamping nut forms a screw connection with said die holder and has a face facing away from said die and laying against said fixing ring.

17. A tool as in claim 16, further comprising a receptacle, said die holder being disposed in said receptacle, said fixing ring being axially adjustably mounted on said receptacle.

18. A tool as in claim 1, further comprising means, including an adjustment mandrel which is insertable into said bore, for rotating the individual discs about said longitudinal axis to adjust said helix angle to a predetermined value t, said adjustment mandrel including a cylindrical body having formed thereon at least one helical ridge having a helix angle equal to t and engaging the a side of the ribs on said discs when said adjustment mandrel is inserted in said bore.

19. A tool as in claim 18, wherein each of said discs has a plurality of said ribs spaced apart with a predetermined spacing said interior surface, and said at least one ridge on said adjustment mandrel has a width less than said predetermined spacing.

20. A tool as in claim 19, wherein said at least one ridge on said adjustment mandrel comprises at least three ridges.

21. A tool as in claim 20, wherein said adjustment mandrel has at five of said ridges thereon.

22. A tool as in claim 1, wherein each of said ribs has a rectangular cross section and, when viewed in a radially outward direction with respect to said longitudinal axis has the shape of a trapezoid having first and second parallel sides, said first side being longer than said second side and being spaced from said second side in said longitudinal extrusion direction.

23. A tool as in claim 22, wherein said first side is between 1.1 and 3 times longer than said second side.

24. A tool as in claim 23, wherein the trapezoid has third and fourth sides respectively forming an obtuse angle and an acute angle with said first side.

25. A tool as in claim 22, wherein the trapezoid has third and fourth sides respective forming an obtuse angle and an acute angle with said first side.

26. A tool as in claim 25, wherein the acute angle is between 30 and 70 degees and the obtuse angle is between 100 and 140 degrees.

27. A tool as in claim 25, wherein the acute angle is between 33 and 50 degees and the obtuse angle is between 110 and 125 degrees.

28. A tool as in claim 1, further comprising means for fixing said mandrel and said die at different positions relative to each other.

29. A tool as in claim 28, wherein said fixing means permits relative movement of said mandrel and said die in said longitudinal direction.

30. A tool as in claim 28, further comprising means for holding said die and said mandrel so as to rotatable relative to one another about said longitudinal axis.

31. A tool as in claim 30, wherein said holding means permits relative movement of said mandrel and said die in said longitudinal direction.

32. A tool as in claim 28, further comprising a ring-shaped mandrel holder holding said mandrel, a die holder receiving said die, a receptacle receiving said die holder, a clamping ring rotatably supported on said die holder releasably clamping together said mandrel holder and said die.

33. A tool as in claim 32, further comprising a straight line guide means axially movably supporting said die holder in said receptacle.

* * * * *